US010174918B2

(12) United States Patent
Li

(10) Patent No.: US 10,174,918 B2
(45) Date of Patent: Jan. 8, 2019

(54) DOWNLIGHT MODULE AND METHOD FOR MANUFACTURING THE SAME

(71) Applicant: XIAMEN ECO LIGHTING CO. LTD., Xiamen (CN)

(72) Inventor: Ke Li, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/622,021

(22) Filed: Jun. 13, 2017

(65) Prior Publication Data

US 2018/0238525 A1 Aug. 23, 2018

(30) Foreign Application Priority Data

Feb. 21, 2017 (CN) ..... 2017 1 0093967

(51) Int. Cl.

| | |
|---|---|
| ***F21K 99/00*** | (2016.01) |
| ***F21V 21/04*** | (2006.01) |
| ***F21S 8/02*** | (2006.01) |
| ***F21V 19/00*** | (2006.01) |
| ***F21V 23/00*** | (2015.01) |
| *F21Y 115/10* | (2016.01) |

(52) U.S. Cl.

CPC ..... *F21V 21/047* (2013.01); *F21S 8/02* (2013.01); *F21V 19/003* (2013.01); *F21V 23/003* (2013.01); *F21Y 2115/10* (2016.08)

(58) Field of Classification Search

CPC .... F21V 21/047; F21V 23/003; F21V 19/003; F21S 8/02; F21Y 2115/10

See application file for complete search history.

(56) References Cited

U.S. PATENT DOCUMENTS

| | | | | |
|---|---|---|---|---|
| 7,874,709 | B1 * | 1/2011 | Beadle | F21S 8/022 362/285 |
| 9,622,314 | B1 * | 4/2017 | Li | H05B 33/0845 |
| 2007/0183154 | A1 * | 8/2007 | Robson | F21V 3/04 362/267 |
| 2009/0003009 | A1 * | 1/2009 | Tessnow | F21V 29/74 362/487 |
| 2011/0141728 | A1 * | 6/2011 | Russello | F21V 3/00 362/235 |
| 2013/0170205 | A1 * | 7/2013 | Abel | B64F 1/205 362/235 |
| 2014/0153255 | A1 * | 6/2014 | Kimiya | F21S 8/04 362/311.02 |
| 2014/0204594 | A1 * | 7/2014 | Kanazawa | F21S 8/026 362/362 |

* cited by examiner

*Primary Examiner* — Tracie Y Green

(74) *Attorney, Agent, or Firm* — Chun-Ming Shih

(57) ABSTRACT

Disclosed herein is a downlight module that includes a light source driving board, an isolating board, a lens module, a back housing, and an input power line. The light source driving board includes a light-emitting diode and a driving circuit. The isolating board has a through hole. The lens module includes a lens housing, wherein the light source driving board and the isolating board are disposed in the lens housing. The back housing covers the lens housing of the lens module. The back housing has an opening, wherein the melting temperature of the back housing is lower than the melting temperature of the lens housing. The input power line is connected with the light source driving board via the opening of the back housing and the through hole of the isolating board.

16 Claims, 13 Drawing Sheets

DOWNLIGHT MODULE AND METHOD FOR MANUFACTURING THE SAME

CROSS-REFERENCE TO RELATED APPLICATION

This application relates to and claims the benefit of Chinese Patent Application No. CN201710093967.2, filed Feb. 21, 2017, the content of which is incorporated herein by reference in its entirety.

BACKGROUND OF THE INVENTION

1. Field of the Invention

The present disclosure relates to a downlight and a method for manufacturing to the same; more particularly, to a downlight having a light-emitting diode and a method for manufacturing the same.

2. Description of Related Art

With the advancement of the technology, many modern lighting apparatuses now use light-emitting diodes (LEDs) as the light source. The downlight is a lighting device that is installed in the ceiling of the building. The downlight has a tubular appearance and can be embedded within the ceiling so that the front surface of the light is level with the ceiling, thereby giving a flat and even look. By placing the LED unit within the downlight, it is feasible to enhance the light efficiency and the aesthetics. However, the conventional many facture process of the downlight involves the assembling of the light source, the lens, the heat dissipation component, and the structural component; such assembling process requires many components and screws. This assembling process cannot achieve a tight sealing and results in many gaps and spaces, and hence, it is not in compliance with the IP65 standards. An additional sealing components is often required to meet the IP65 standards, thereby resulting in a more complicated manufacturing process, which is more costly. In view of the foregoing, there is an urgent need in the industrial field of the LED lighting to provide a novel downlight that simplifies the manufacturing process and satisfies the IP65 standards.

SUMMARY

In light of the foregoing technical problems, the present inventor proposes the following embodiments to respectively address some or all of the technical problems.

One purpose of the present invention is to provide a downlight module, which does not require a screw for assembling. Another purpose of the present invention is to provide a downlight module, which is easy to assemble and comprises minimal components. Still another purpose of the present invention is to provide a downlight module that is in compliance with the IP65 standards.

According to one embodiment of the present invention, a downlight is provided. Said downlight comprises a light source driving board, an isolating board, a lens module, a back housing, and an input power line. The light source driving board comprises a light-emitting diode unit and a driving circuit. The isolating board has a through hole. The lens module comprises a lens housing, wherein the light source driving board and the isolating board are disposed in the lens housing. The back housing covers the lens housing of the lens module. The back housing has an opening, and the melting point of the back housing is lower than the melting point of the lens housing. The input power line is connected with the light source driving board via the opening of the back housing and the through hole of the isolating board.

According to another embodiment of the present invention, a downlight assembly is provided. The downlight assembly comprises a light source driving board, an isolating board, lens module, back housing, input power line, a rim, a clip element, and a clamping spring. The light source driving board comprises a light-emitting diode, and a driving circuit. The isolating board has a through hole. The lens module comprises a lens housing, wherein the light source driving board and the isolating board are disposed in the lens housing. The back housing covers the lens housing of the lens module, the back housing has an opening, and the melting temperature of the back housing is lower than the melting temperature of the lens housing. The input power line is connected with the light source driving board via the opening of the back housing and the through hole of the isolating board. The rim comprises a tubular sidewall. The clip element secures the back housing and the rim with each other. The clamping spring is fixed on the tubular sidewall.

According to yet another embodiment of the present invention, a method for manufacturing a downlight module is provided, in which the method comprises the steps as follows. First, an input power line is passed through an isolating board via a through hole. Then, the input power line is connected with a light source driving board. Next, the light source driving board and the isolating board are placed within a lens housing of a lens module. Thereafter, a back housing is formed by injection molding, in which the back housing covers the lens housing of the lens module.

As could be appreciated, this section presents a simplified summary of the disclosure in order to provide a basic understanding to the reader. This summary is not an extensive overview of the disclosure and it does not identify key/critical elements of the present invention or delineate the scope of the present invention.

BRIEF DESCRIPTION OF THE DRAWINGS

The present description will be better understood from the following detailed description read in light of the accompanying drawings as set forth below.

Figure 1:
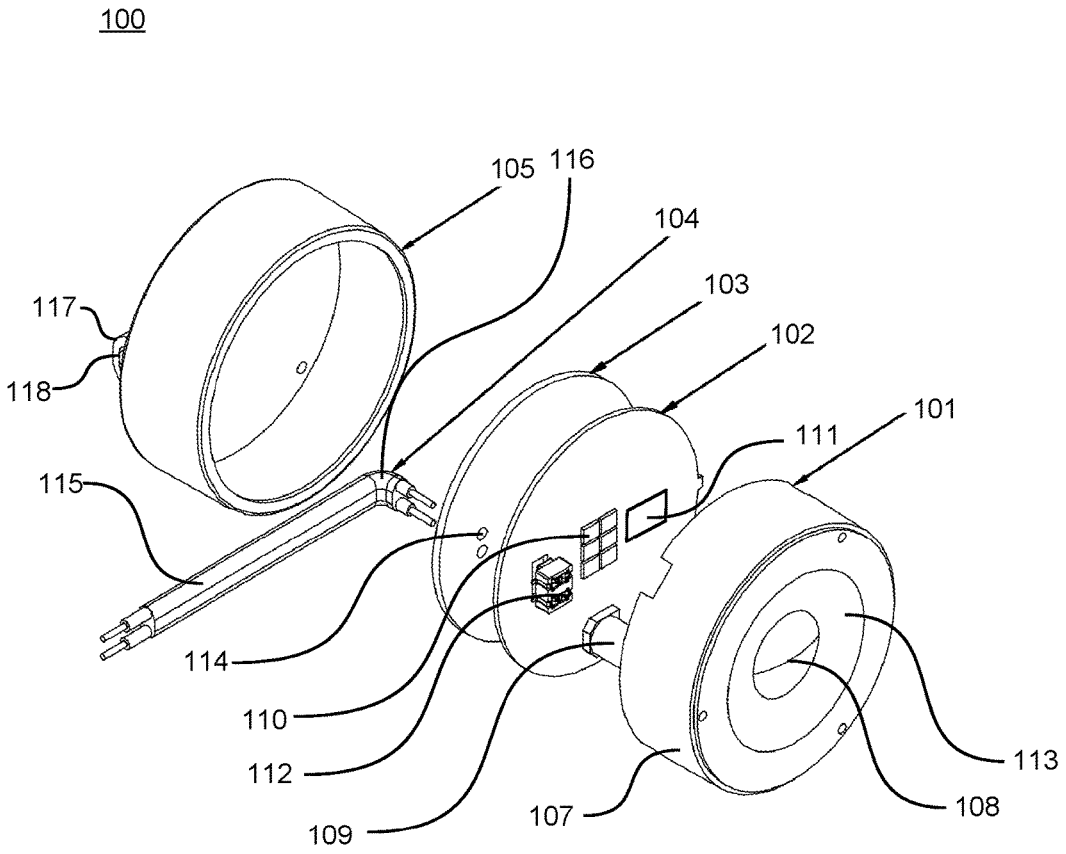
FIG. 1 is an exploded diagram illustrating a downlight module according to one embodiment of the present disclosure.

In accordance with common practice, the various described features/elements are not drawn to scale but instead are drawn to best illustrate specific features/elements relevant to the present invention. Also, like reference numerals and designations in the various drawings are used to indicate like elements/parts.

DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

FIG. 1 is an exploded diagram illustrating a downlight module according to one embodiment of the present disclosure. Referring to FIG. 1, the downlight module 100 comprises a lens module 101, a light source driving board 102, an isolating board 103, an input power line 104, and a back housing 105. The light source driving board 102 comprises a light-emitting diode 110 and a driving circuit 111. In some embodiments, the back housing 105 is made from polyvinyl chloride (PVC) and formed by injection molding. The lens module 101 comprises lens 108 and a lens housing 107. The light source driving board 102 is connected with the lens module 101. In some embodiments, the lens housing 107 is light-transmissible.

In some embodiments, lens 108 and the lens housing 107 are made from the same material as one-piece. In some embodiments, the light source driving board 102 is connected with the lens module 101 via a column 109. The column 109 may be cylindrical or rectangular in shape or have any other suitable shape. In some embodiments, the light source driving board 102 comprises a terminal 112. The terminal 112 is connected with the power line 104, and the terminal 112 supplies the electricity to the light-emitting diode 110 and the driving circuit 111. In some embodiments, the terminal 112 is raised above the light source driving board 102. The column 109 comprises a hollow portion; said hollow portion is configured to accommodate the raised portion of the terminal 112.

In some embodiments, the lens housing 107 has a cylindrical shape, and both the light source driving board 102 and the isolating board 103 is shaped as a circular plate. The diameter of the light source driving board 102 is the same as the diameter of the inner wall of the lens housing 107; that is, the light source driving board 102 may be directly pressed into the lens housing 107, and tightly join with the lens housing 107. Similarly, the diameter of the isolating board 103 is also the same as the diameter of the inner wall of the lens housing 107; that is, the isolating board 103 may be directly pressed into the lens housing 107, too. When the light source driving board 102 and the isolating board 103 are pressed into the lens housing 107 simultaneously, the two may tightly attach with each other. The first function of the isolating board 103 is isolation, and the second one is to serve as a protecting layer for the light source driving board 102 during the injection molding process of the back housing 105. In some embodiments, the front surface 113 of the lens module 101 is a flat surface. In some embodiments, the front surface 113 of the lens module 101 is a concave surface. The lens module 101 comprises a plurality of lens for focusing or collimating the light. Depending on the design need, the lens module 101 may have a particulate or wavy portion, or a portion with other irregular shape, so that the light may be scattered or diffused to give a more uniform light that make the user feel less dazzled.

In some embodiments, the isolating board 103 has a through hole 114 thereon, which is configured to allow the passage of the input power line 104. The input power line 104 passes through the through hole 114 and connects with the light source driving board 102. In some embodiments, the isolating board 103 has two through holes 114 thereon, which are configured to allow the passage of the live wire and the neutral wire of the input power line 104, respectively. In some embodiments, an outer layer 115 covers a portion of the input power line 104 that is outside the isolating board 103. The outer layer 115 provides a better protection for the input power line 104. Meanwhile, the outer layer 115 may also increase the support strength of the input power line 104, so that when the user holds the input power line 104 with a hand or tool, the user may lift the whole downlight module 100 without substantial downward bulging.

When the users hold the input power line 104 with a hand or tool in the horizontal orientation, the downward bulging angle of the downlight module 100 does not exceed 45 degrees. Therefore, the coverage of the outer layer 115 provides an improved hardness and support to the input power line 104. In some embodiments, the input power line 104 has a bent portion 116; said bent portion is configured to keep the front 113 of the lens module 1101 downward even when the input power line 104 is held by the hand or tool in the horizontal orientation. In some embodiments, the bent portion 116 is covered with the outer layer 115. The coverage of the outer layer 115 of the bent portion 116 increases the hardness of the bent portion 116, thereby enhancing the protective ability and at the same time maintaining the angle of the bent portion 116. In some embodiments, the angle of the bent portion 116 is in the range of 70 degrees to 120 degrees.

In some embodiments, the back of the back housing 105 has a raised cap 117. The raised cap 117 has an opening 118 for accommodating the input power line 104. In some embodiments, the raised cap 117 is shaped to accommodate the bent portion 116 of the input power line 104 neatly. The opening 118 runs through the back housing 105, and the input power line 104 passes through the opening 118 and the through hole 114 to connect with the light source driving board 102 and thereby provides electricity to the light source driving board 102. In some embodiments, the bent portion 116 has the coverage of the outer layer 115, and the outer layer 115 is further covered by the raised cap 117; said structural design for multiple coverage satisfies the pulling requirement for the input power line 104 and is also in compliance with the IP65 standards. The IP65 standard belongs to a standardized International (or Ingress) Protection Code system for measuring the capabilities of electronic devices enclosure against the invasion of foreign objects. These standards including the protection for explosion, mist, and dust. These standards are formulated according to the IEC 60529 standard of International Electrotechnical Commission (IEC), which is adopted by the United States of America in 2004 as the national standard.

Figure 13:
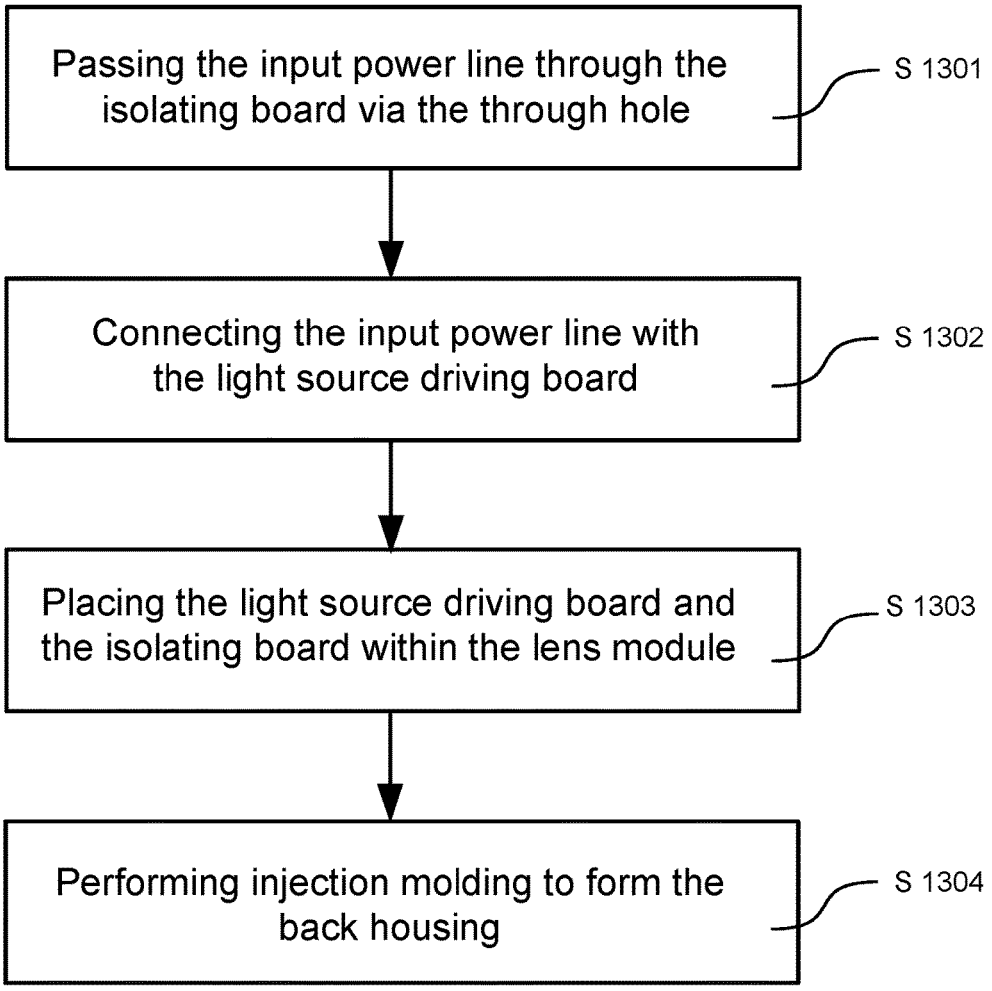
FIG. 13 is a flow chart illustrating the method steps for manufacturing a downlight module.

FIG. 13 is a flow chart illustrating the method steps for manufacturing the downlight module. Referring to FIG. 1 and FIG. 13, a method for manufacturing the downlight module 100 is provided according to one embodiment of the present disclosure. First, the input power line 104 is passed through the isolating board 103 via the through hole 114 (Step 1301). Then, the input power line 104 is connected with the light source driving board 102 (Step 1302). Next, the light source driving board 102 and the isolating board 103 are placed within the lens module 101 (Step 1303), so that the light source driving board 102 and the isolating board 103 are embedded in the lens module 101. Since the diameters of the light source driving board 102 and the isolating board 103 are the same as the inner diameter of the casing 107 of the lens module 101, the light source driving board 102 and the isolating board 103 may tightly attach to the inner surface of the casing 107 of the lens module 101. In this way, when the downlight module is shaken, the source driving board 102 and the isolating board 103 would not shift off position.

In another embodiment, the diameters of the light source driving board 102 and the isolating board 103 are not the same as the inner diameter of the casing 107 of the lens module 101, but the inner surface of the casing 107 of the lens module 101 has a baffle, groove, slot, or any suitable structure of the guiding or piloting groove, and the light source driving board 102 and the isolating board 103 have a raised or recess structure corresponding to the baffle, groove, slot, or the guiding or piloting groove, so that when the light source driving board 102 and the isolating board 103 are placed within the lens module 101, they may securely attach with the lens module 101 and will not come-off easily.

Thereafter, the input power line 104 is held by hand or a tool, and the downlight module 100 is lifted and transferred into the apparatus for injection molding. Then, the injection molding process is carried out to form the back housing 105 (Step 1304). The temperature for carrying out the injection molding process is lower than the heat deflection temperature of the lens module 101. The temperature for carrying out the injection molding process is also lower than the heat deflection temperature of the isolating board 103. The back housing is formed by injection molding, and hence, the melting temperature of the back housing is lower than the melting temperature of the lens housing, so that the back housing would not deflect or melted during the injection molding process. After the injected material is cooled down, the injection molding process is completed. The above-mentioned manufacturing process is different from the conventional manufacturing process in which the assembling requires the use of screws for fixing parts.

Figure 2:
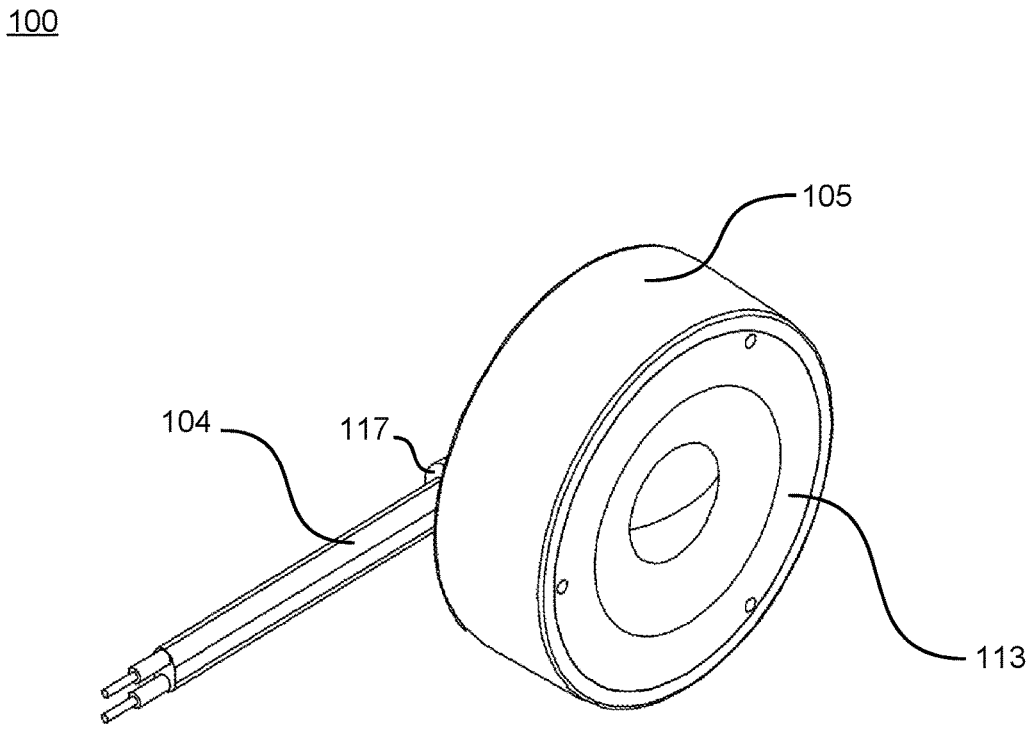
FIG. 2 schematically illustrates a downlight module upon the completion of the injection-molding step.

FIG. 2 is the downlight module upon the completion of the injection molding process. Reference is made to FIG. 1 and FIG. 2; after the completion of the injection molding process, only the front 113, the input power line 104, the back housing 105 and the raised cap 117 of the lens module 101 may be observed from the appearance of the downlight module 100. It should be noted that the raised cap 117 and the opening 118 may be formed during the injection molding process, so that the input power line 104 may pass through the back housing 105 via the opening 118. In this way, the input power line 104 and the raised cap 117 may form a tight attachment during the injection molding process, and hence, the IP65 standard is met despite the gap between the input power line 104 and the raised cap 117. In some embodiments, the inject-molded back housing 105 is tightly secured on the lens housing 107; such manufacturing process result in a downlight module 100 with a desirable overall sealability that is in compliance with the IP65 standards and gives an integrally-formed structural design. This downlight module 100 is easy to assemble and has a simple appearance, which finds wide applications.

Figure 3:
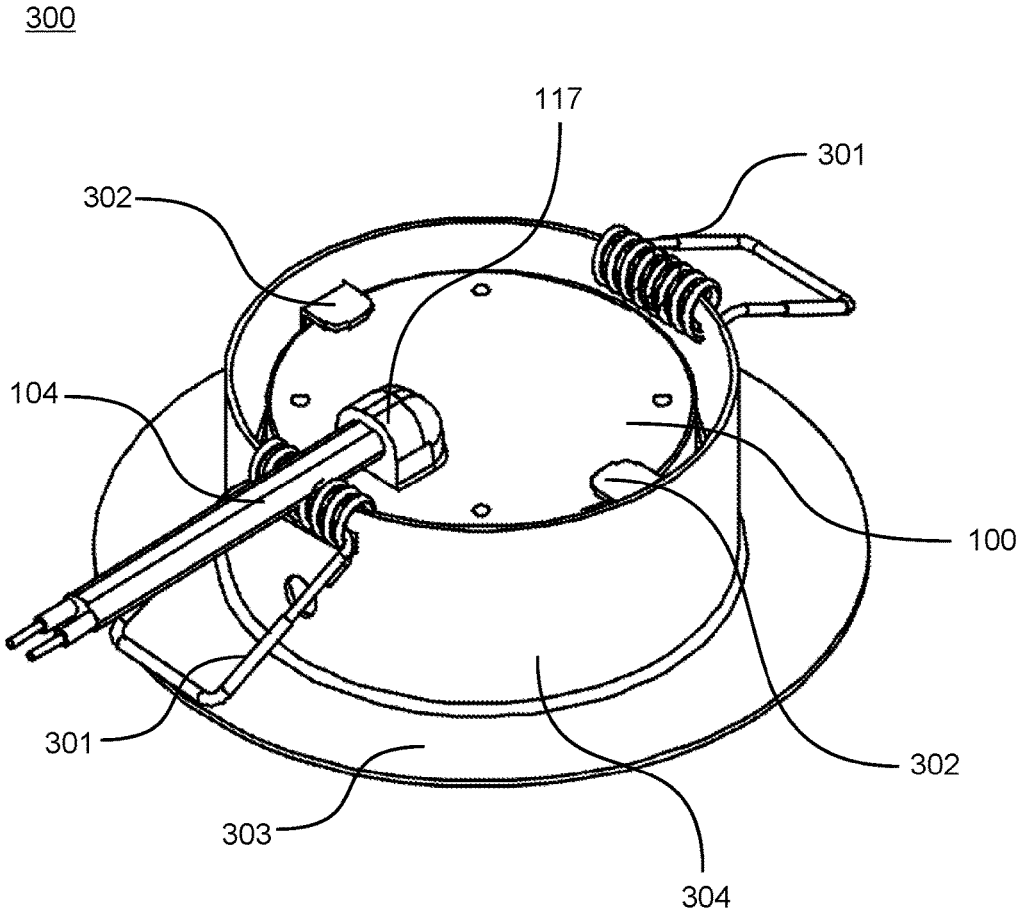
FIG. 3 is a back-perspective view of a downlight module with a circular rim.
Figure 4:
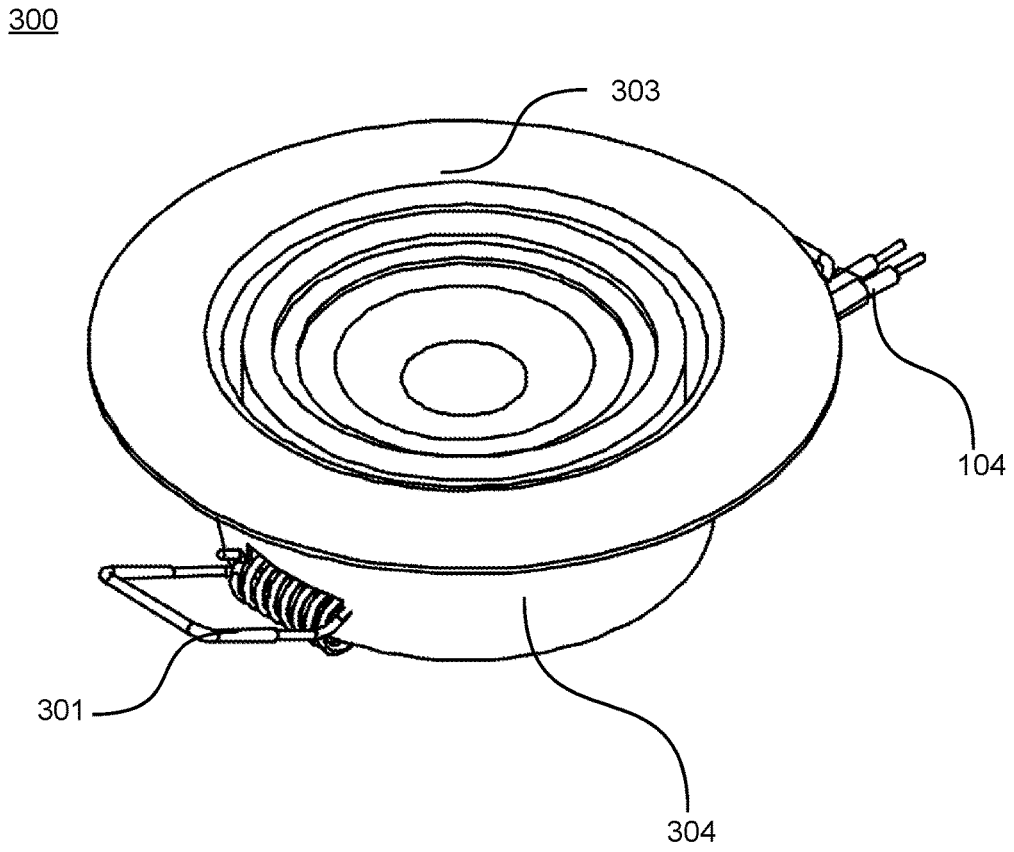
FIG. 4 is a front-perspective view of the downlight module with the circular rim.
Figure 5:
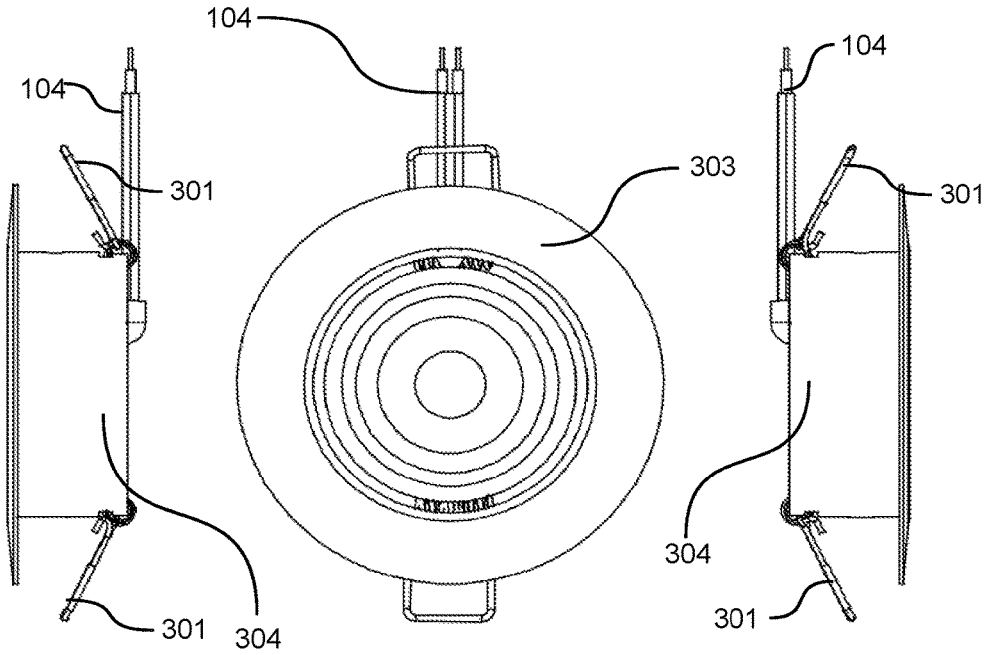
FIG. 5 shows a front top perspective view and a lateral perspective view of the downlight module with the circular rim.
Figure 6:
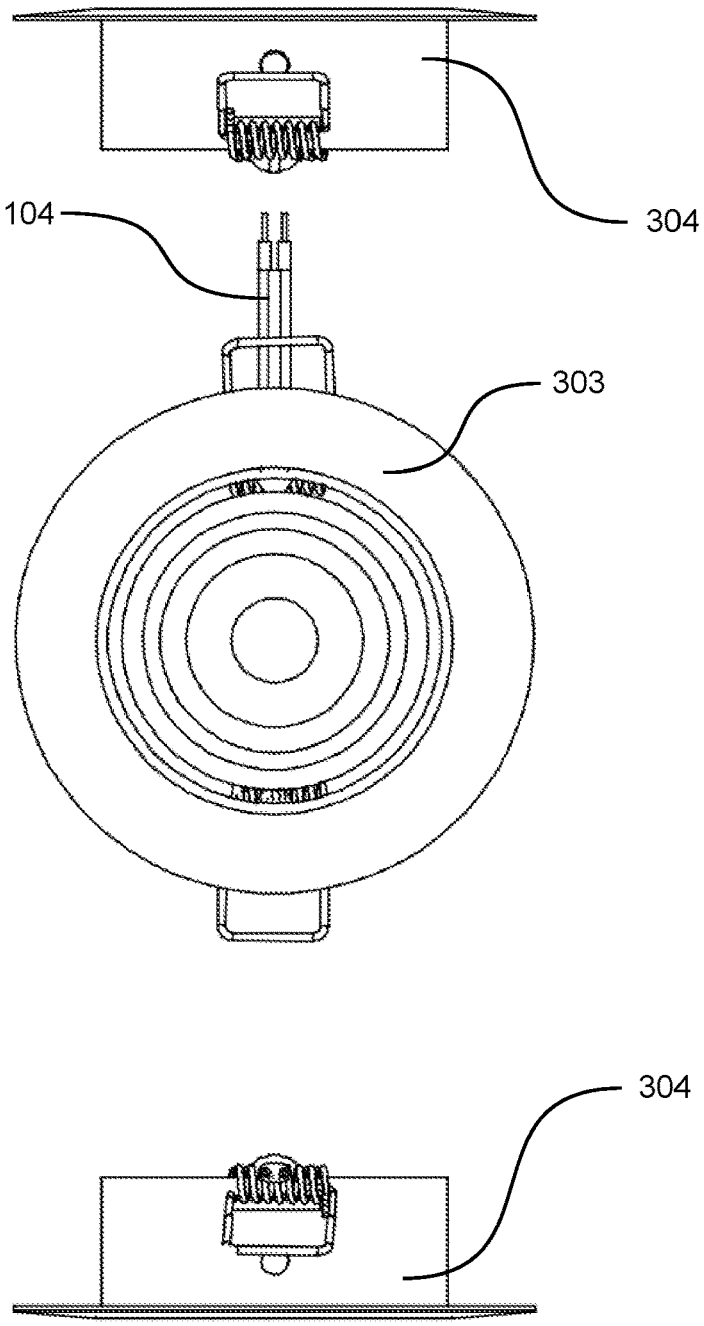
FIG. 6 shows a front top perspective view and the other lateral perspective view of the downlight module with the circular rim.
Figure 7:
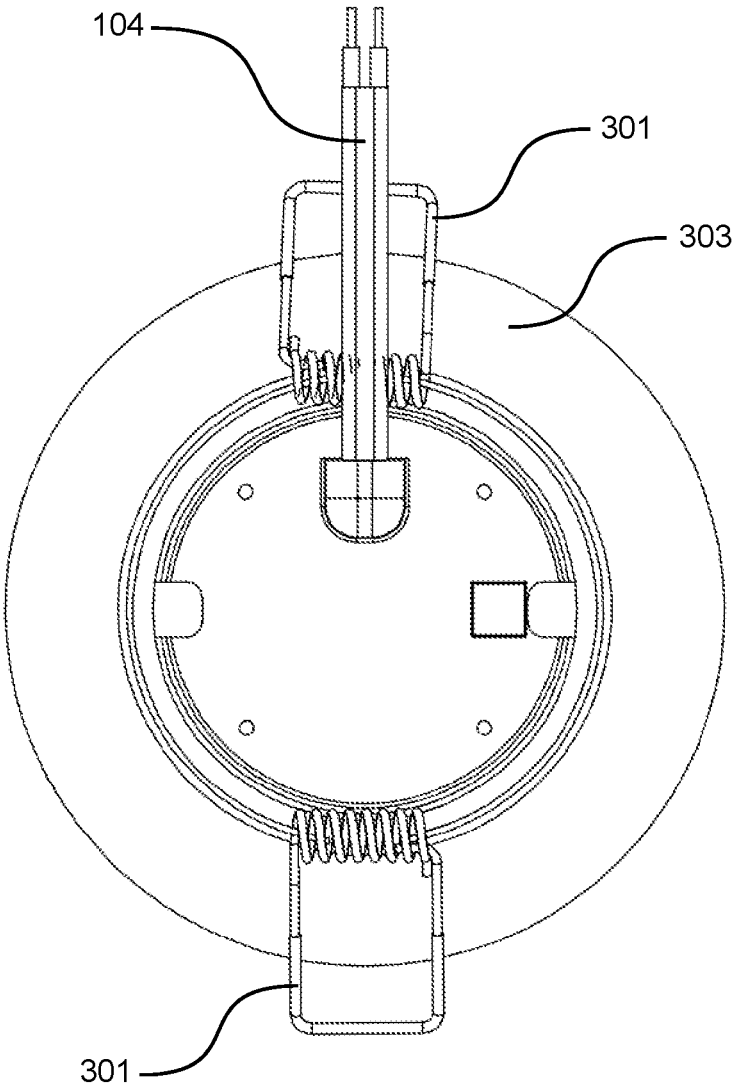
FIG. 7 is a back top perspective view of the downlight module with the circular rim.

FIG. 3 is a back-perspective view of a downlight module with a circular rim. FIG. 4 is a front-perspective view of the downlight module with the circular rim. FIG. 5 shows a front top perspective view and a lateral perspective view of the downlight module with the circular rim. FIG. 6 shows a front top perspective view and the other lateral perspective view of the downlight module with the circular rim. FIG. 7 is a back top perspective view of the downlight module with the circular rim. Referring to FIG. 3, FIG. 4, FIG. 5, FIG. 6, and FIG. 7, in some embodiments, the downlight module 100 and a circular rim 303 forms a downlight assembly 300. The circular rim 303 is fixed on the downlight module 100 using the clip element 302. The circular rim 303 further comprises a tubular sidewall 304 and two clamping springs 301 fixed on the tubular sidewall 304. After the clamping spring 301 is opened, the circular rim 303 and the downlight module 100 may be fixed on the ceiling.

Figure 8:
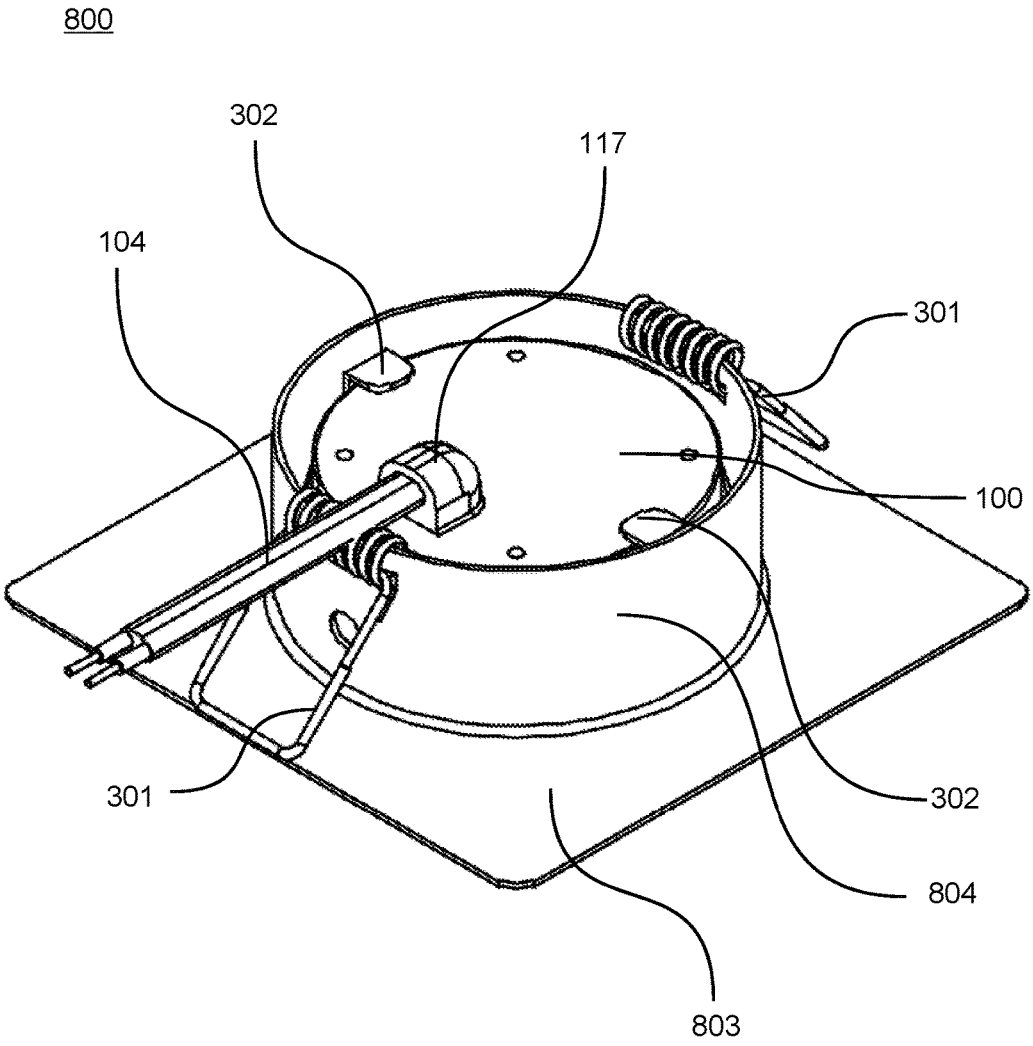
FIG. 8 is a back-perspective view of a downlight module with a square rim.
Figure 9:
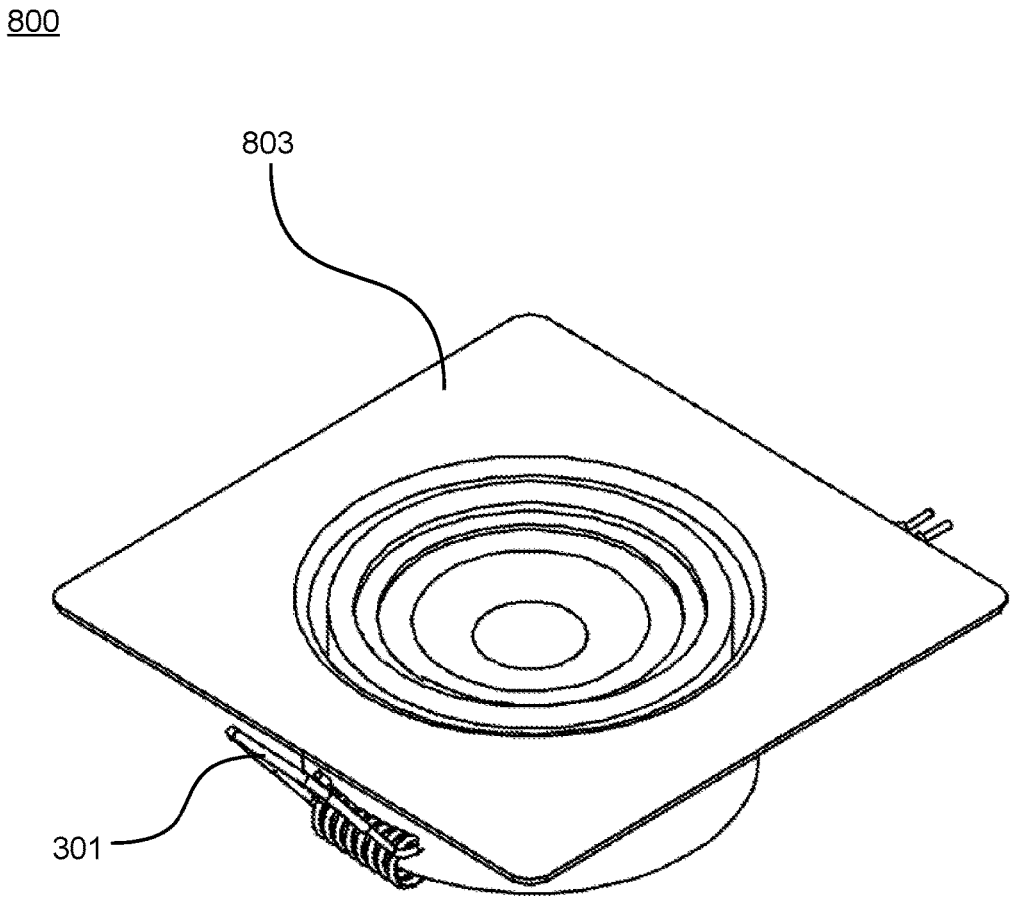
FIG. 9 is a front-perspective view of the downlight module with the square rim.
Figure 10:
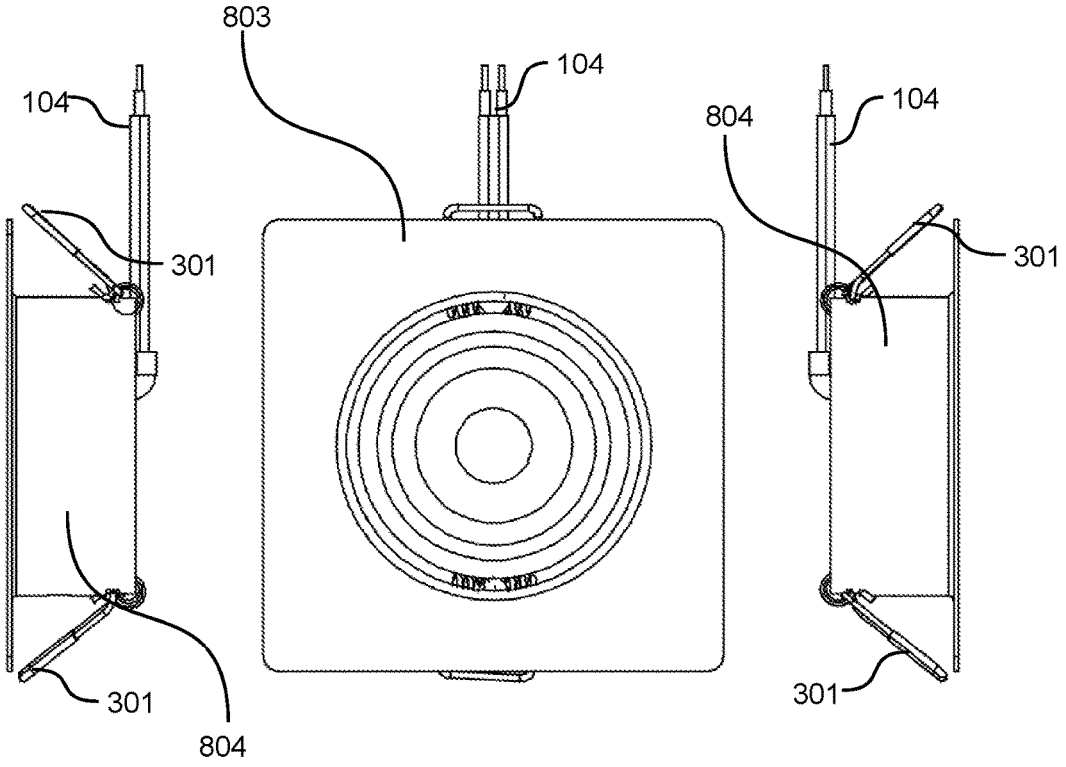
FIG. 10 shows a front top perspective view and a lateral perspective view of the downlight module with the square rim.
Figure 11:
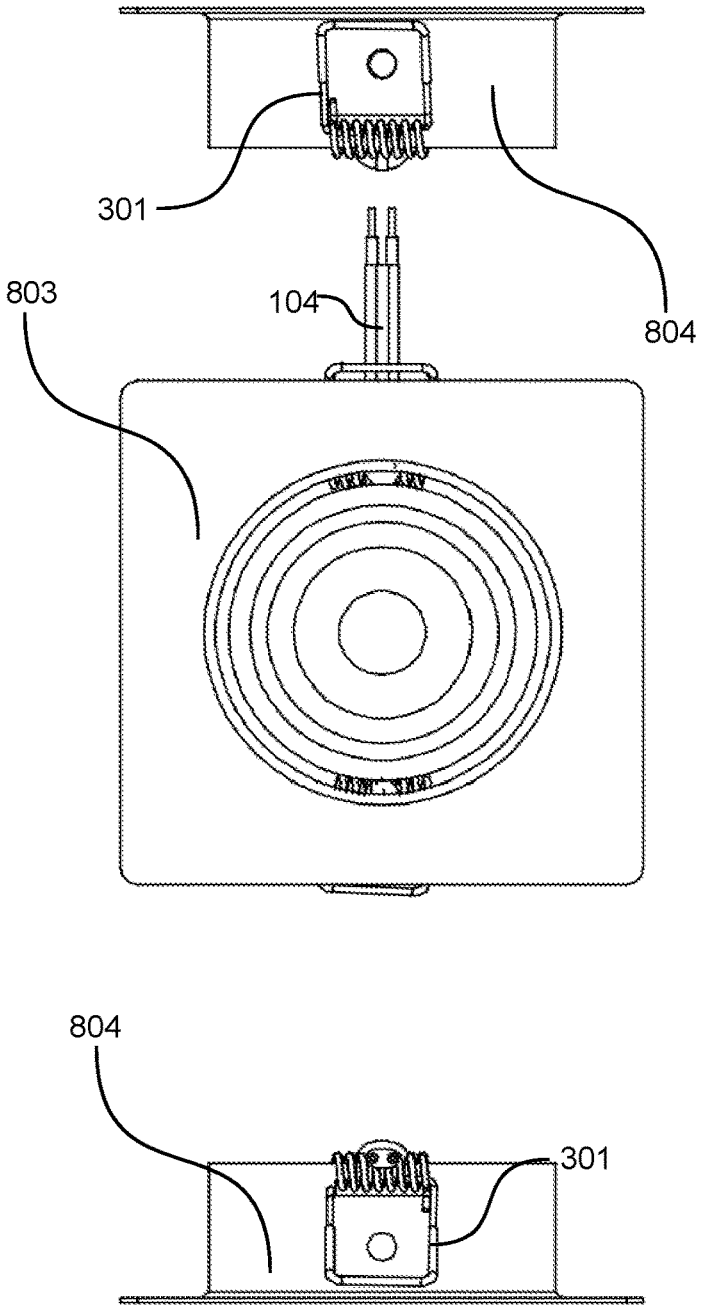
FIG. 11 shows a front top perspective view and the other lateral perspective view of the downlight module with the square rim.
Figure 12:
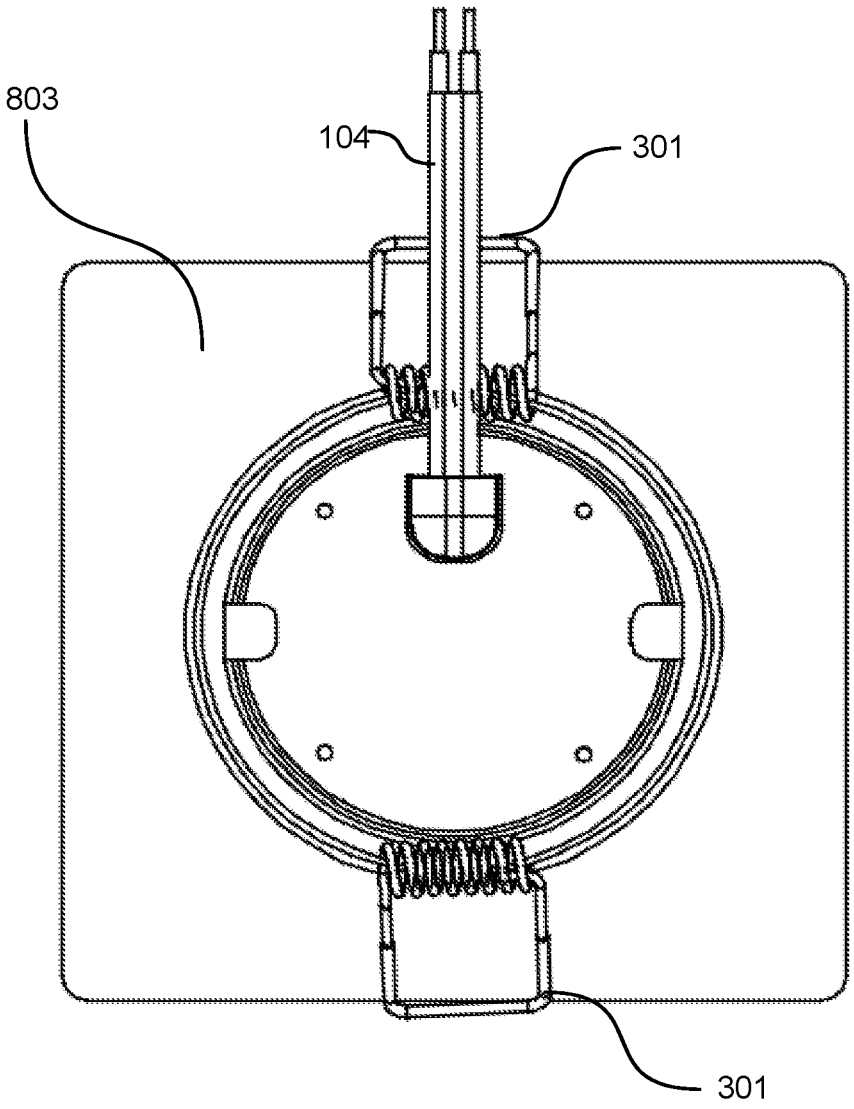
FIG. 12 is a back top perspective view of the downlight module with the square rim.

FIG. 8 is a back-perspective view of a downlight module with a square rim. FIG. 9 is a front-perspective view of the downlight module with the square rim. FIG. 10 shows a front top perspective view and a lateral perspective view of the downlight module with the square rim. FIG. 11 shows a front top perspective view and the other lateral perspective view of the downlight module with the square rim. FIG. 12 is a back top perspective view of the downlight module with the square rim. Referring to FIG. 8, FIG. 9, FIG. 10, FIG. 11, and FIG. 12, in some embodiments, the downlight module 100 and a square rim 803 forms a downlight assembly 800. The square rim 803 is fixed on the downlight module 100 using the clip element 302. The square rim 803 further comprises a tubular sidewall 804 and two clamping springs 301 fixed on the tubular sidewall 804. After the clamping spring 301 is opened, the square rim 803 and the downlight module 100 may be fixed on the ceiling.

The above-mentioned embodiments may solve one or more technical problems due to their respective technical feature(s). Although various embodiments of the invention have been described above with a certain degree of particularity, or with reference to one or more individual embodiments, those with ordinary skill in the art could make numerous alterations to the disclosed embodiments, such as the addition or deletion of one or more elements, without departing from the spirit or scope of this invention.

What is claimed is:

1. A downlight module, comprising, a light source driving board, comprising a light-emitting diode and a driving circuit;

an isolating board, having a through hole;

a lens module, comprising a lens housing, wherein the light source driving board and the isolating board are disposed in the lens housing;

a back housing, covering the lens housing of the lens module, wherein the back housing has an opening, and the melting temperature of the back housing is lower than the melting temperature of the lens housing; and an input power line, wherein the input power line is connected with the light source driving board via the opening of the back housing and the through hole of the isolating board.

2. The downlight module according to the claim 1, wherein the back housing is made from a material comprising polyvinyl chloride (PVC).

3. The downlight module according to the claim 1, wherein the lens housing is light-transmissible.

4. The downlight module according to the claim 1, wherein the lens module comprises a guiding and piloting structure for fixing the light source driving board and the isolating board.

5. The downlight module according to the claim 1, wherein the input power line has a bent portion, and the back housing comprises a raised cap for accommodating the bent portion of the input power line.

6. The downlight module according to the claim 5, wherein the bent portion has an angle of 70 degrees to 120 degrees.

7. The downlight module according to the claim 1, wherein the isolating board has two through holes respectively configured to allow the passage of the live wire and the neutral wire of the input power line.

8. A downlight assembly, comprising, a light source driving board, comprising a light-emitting diode and a driving circuit;

an isolating board, having a through hole;

a lens module, comprising a lens housing, wherein the light source driving board and the isolating board are disposed in the lens housing;

a back housing, covering the lens housing of the lens module, wherein the back housing has an opening, and the melting temperature of the back housing is lower than the melting temperature of melting temperature of the lens housing;

an input power line, wherein the input power line is connected with the light source driving board via the opening of the back housing and the through hole of the isolating board;

a rim, comprising a tubular sidewall;

a clip element, wherein the clip element secures the back housing and the rim with each other; and a clamping spring, fixed on the tubular sidewall.

9. The downlight assembly according to the claim 8, wherein the back housing is made from a material comprising polyvinyl chloride (PVC).

10. The downlight assembly according to the claim 8, wherein the lens housing is light-transmissible.

11. The downlight assembly according to the claim 8, wherein the lens module comprises a guiding and piloting structure for fixing the light source driving board and the isolating board.

12. The downlight assembly according to the claim 8, wherein the input power line has a bent portion, and the back housing comprises a raised cap for accommodating the bent portion of the input power line.

13. The downlight assembly according to the claim 12, wherein the bent portion has an angle of 70 degrees to 120 degrees.

14. The downlight assembly according to the claim 8, wherein the isolating board has two through holes respectively configured to allow the passage of the live wire and the neutral wire of the input power line.

15. The downlight assembly according to the claim 8, wherein the rim is a circular rim.

16. The downlight assembly according to the claim 8, wherein the rim is a square rim.

* * * * *